US006474199B1

(12) United States Patent
Szasz

(10) Patent No.: US 6,474,199 B1
(45) Date of Patent: Nov. 5, 2002

(54) DRAIN INSTALLATION APPARATUS

(76) Inventor: Andras Szasz, 226 Southfield Rd., Ecorse, MI (US) 48229

( * ) Notice: Subject to any disclaimer, the term of this patent is extended or adjusted under 35 U.S.C. 154(b) by 0 days.

(21) Appl. No.: 10/093,430

(22) Filed: Mar. 8, 2002

(51) Int. Cl.[7] ..... B25B 13/00

(52) U.S. Cl. ..... 81/52; 81/461; 81/176.15; 81/124.2; 81/180.1

(58) Field of Search ..... 81/52, 55, 13, 81/461, 176.1, 176.15, 176.2, 124.2, 180.1

(56) References Cited

U.S. PATENT DOCUMENTS

| | | | | |
|---|---|---|---|---|
| 2,131,687 A | | 9/1938 | Kaplan | |
| 2,956,461 A | | 10/1960 | Anderson | |
| 4,328,761 A | | 5/1982 | Dwyer | |
| 4,836,065 A | * | 6/1989 | Setliff | 81/124.2 |
| 5,090,276 A | * | 2/1992 | Groskey | 81/176.15 |
| 5,103,698 A | | 4/1992 | Delaney | |
| 5,214,985 A | * | 6/1993 | Rinehart | 81/176.15 |
| 5,410,793 A | | 5/1995 | Vanbibber | |
| 5,429,019 A | * | 7/1995 | Davey | 81/176.15 |
| D392,160 S | | 3/1998 | Schmidt | |
| 5,946,990 A | * | 9/1999 | Bonacci | 30/103 |
| 6,176,157 B1 | * | 1/2001 | Ure | 81/124.2 |
| 6,276,242 B1 | * | 8/2001 | Wiggins et al. | 81/119 |

* cited by examiner

*Primary Examiner*—James G. Smith
*Assistant Examiner*—Hadi Shakeri

(57) ABSTRACT

A drain installation apparatus for installing a drain assembly in a drain hole of a plumbing fixture. The drain installation apparatus includes a bridging member for bridging over the drain hole. A support member extends toward the drain hole when the bridging member is positioned over the drain hole. A holding member engages a top of the drain assembly. A handle member is mounted on the support member for being gripped by a hand of a user to rotate the support member. An attachment member is mounted on the bridging member for releasably mounting on an inner surface of the plumbing fixture adjacent to the drain hole. A cup member engages an upper fastener of the drain assembly. A lower handle member is mounted on the cup member for gripping by the hand of the user to produce rotation of the cup member. An engaging member engages a lower fastener of the drain assembly.

17 Claims, 4 Drawing Sheets

FIG. 3
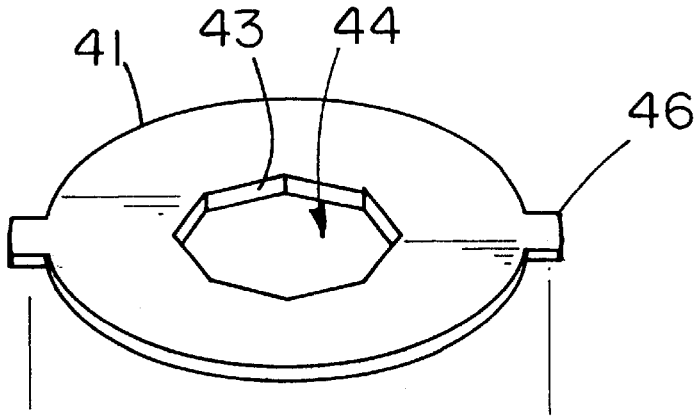
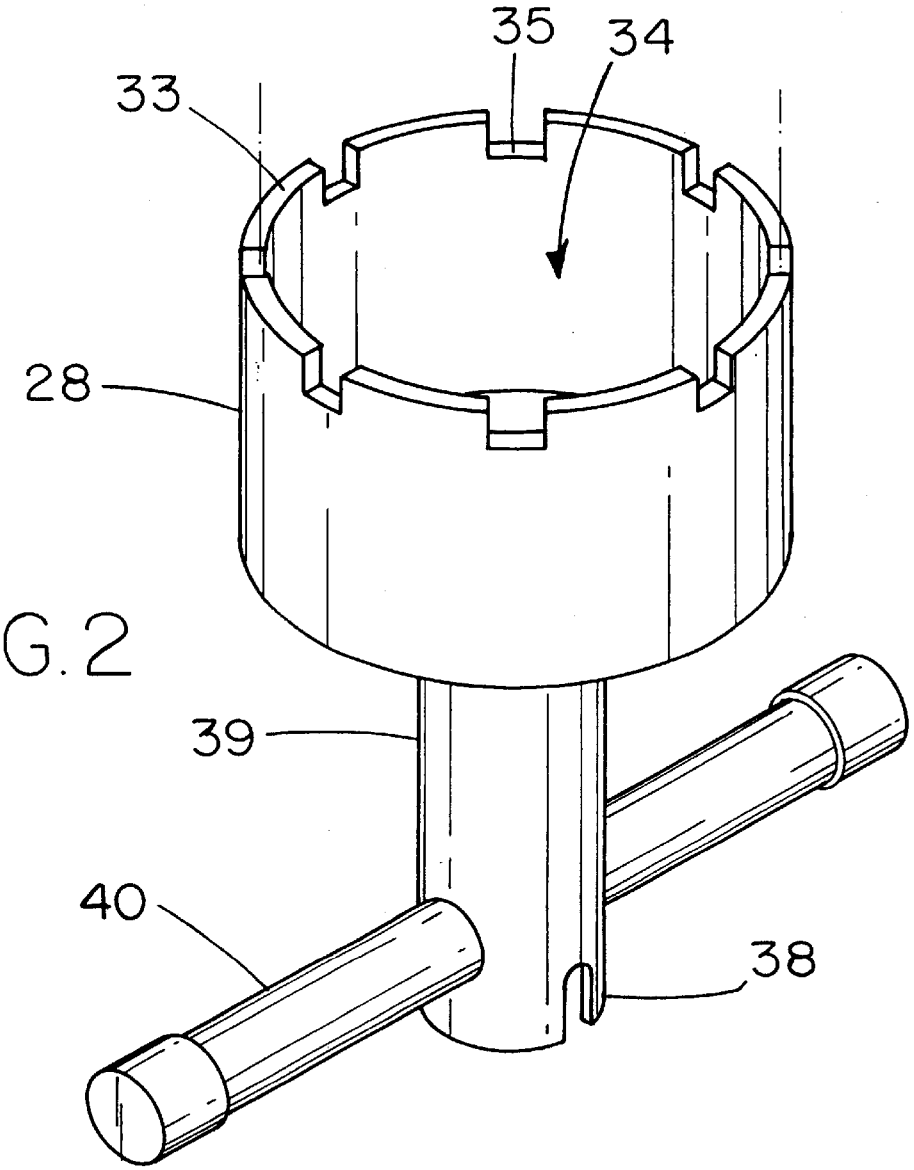
FIG. 2

DRAIN INSTALLATION APPARATUS

BACKGROUND OF THE INVENTION

1. Field of the Invention

The present invention relates to plumbing tools and more particularly pertains to a new drain installation apparatus for installing a drain assembly in a drain hole of a plumbing fixture.

2. Description of the Prior Art

The use of plumbing tools is known in the prior art. U.S. Pat. No. 5,103,698 describes a device for use in the attachment of a drain basket to a drain hole in a basin or the like. Another type of plumbing tool is U.S. Pat. No. 2,956,461 is a spanner type wrench for engaging the strainer portion of a drain basket for installation and/or removal.

While these devices fulfill their respective, particular objectives and requirements, the need remains for a device that allows a single person to hold a drain assembly in place while simultaneously securing the required fastener on the bottom side of the fixture.

SUMMARY OF THE INVENTION

The present invention meets the needs presented above by providing the user with a tool assembly to first hold the drain assembly in place, and another to then secure the drain to the sink.

Still yet another object of the present invention is to provide a new drain installation apparatus that makes the installation process much faster.

Even still another object of the present invention is to provide a new drain installation apparatus that is adaptable to all kinds of standard fixtures and drain assemblies, making it very universal in nature.

To this end, the present invention generally comprises a bridging member for bridging over the drain hole. A support member extends toward the drain hole when the bridging member is positioned over the drain hole. A holding member engages a top of the drain assembly. A handle member is mounted on the support member for being gripped by a hand of a user to rotate the support member. An attachment member is mounted on the bridging member for releasably mounting on an inner surface of the plumbing fixture adjacent to the drain hole. A cup member engages an upper fastener of the drain assembly. A lower handle member is mounted on the cup member for gripping by the hand of the user to produce rotation of the cup member. An engaging member engages a lower fastener of the drain assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a schematic perspective view of the cup member of the present invention.

FIG. 3 is a schematic perspective view of the engaging member of the present invention.

DESCRIPTION OF THE PREFERRED EMBODIMENT

Figure 1:
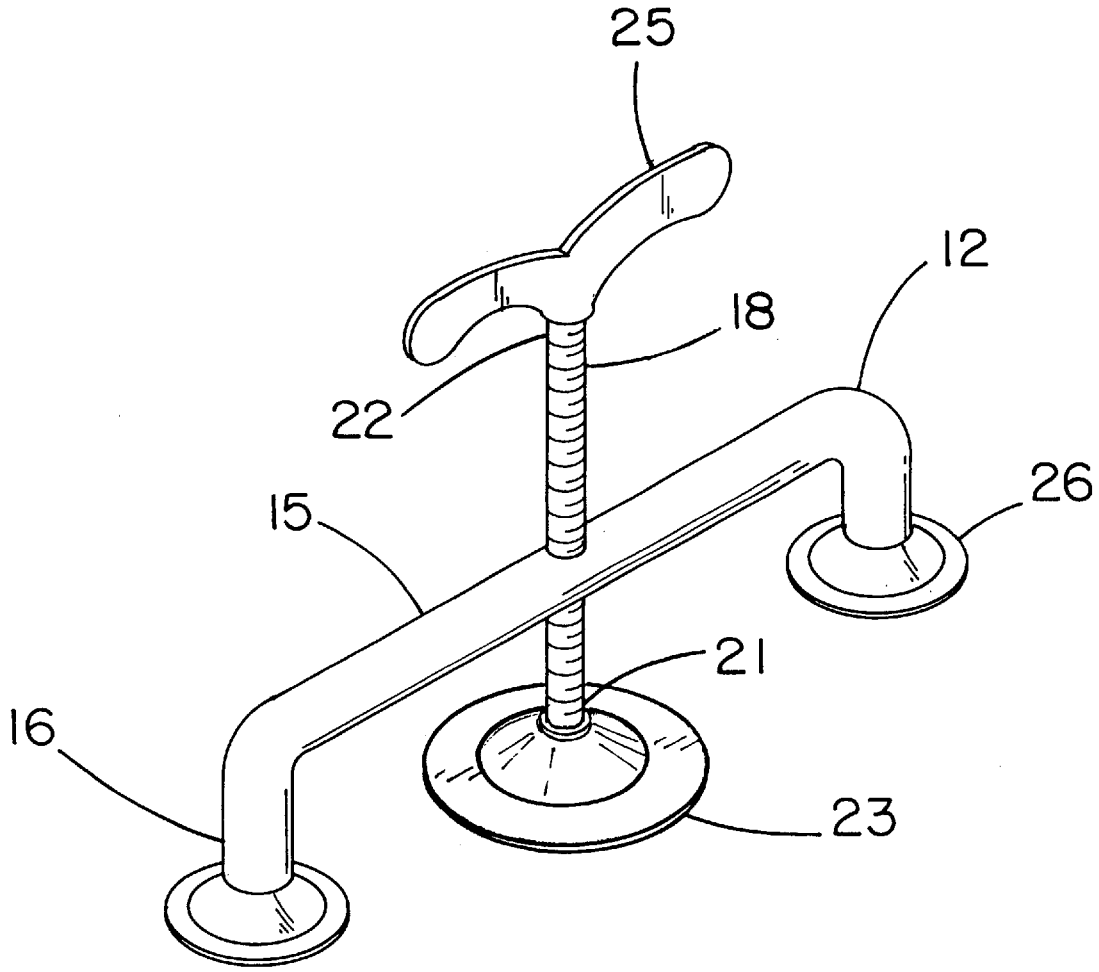
FIG. 1 is a schematic perspective view of the upper holding member of a new drain installation apparatus according to the present invention.
Figure 4:
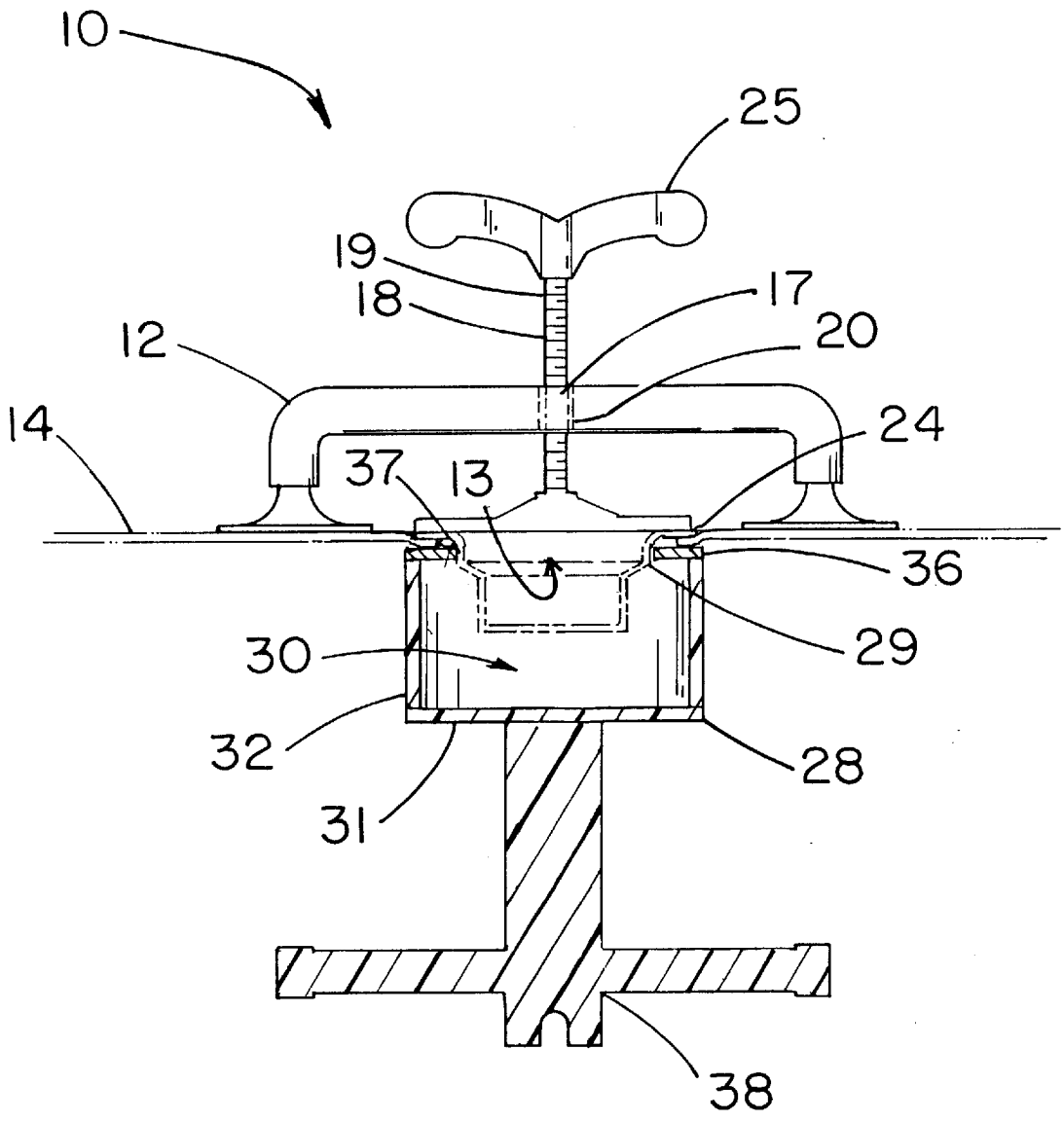
FIG. 4 is a schematic side view of the present invention utilizing only the cup member to secure the drain assembly utilizing the upper fastener.
Figure 5:
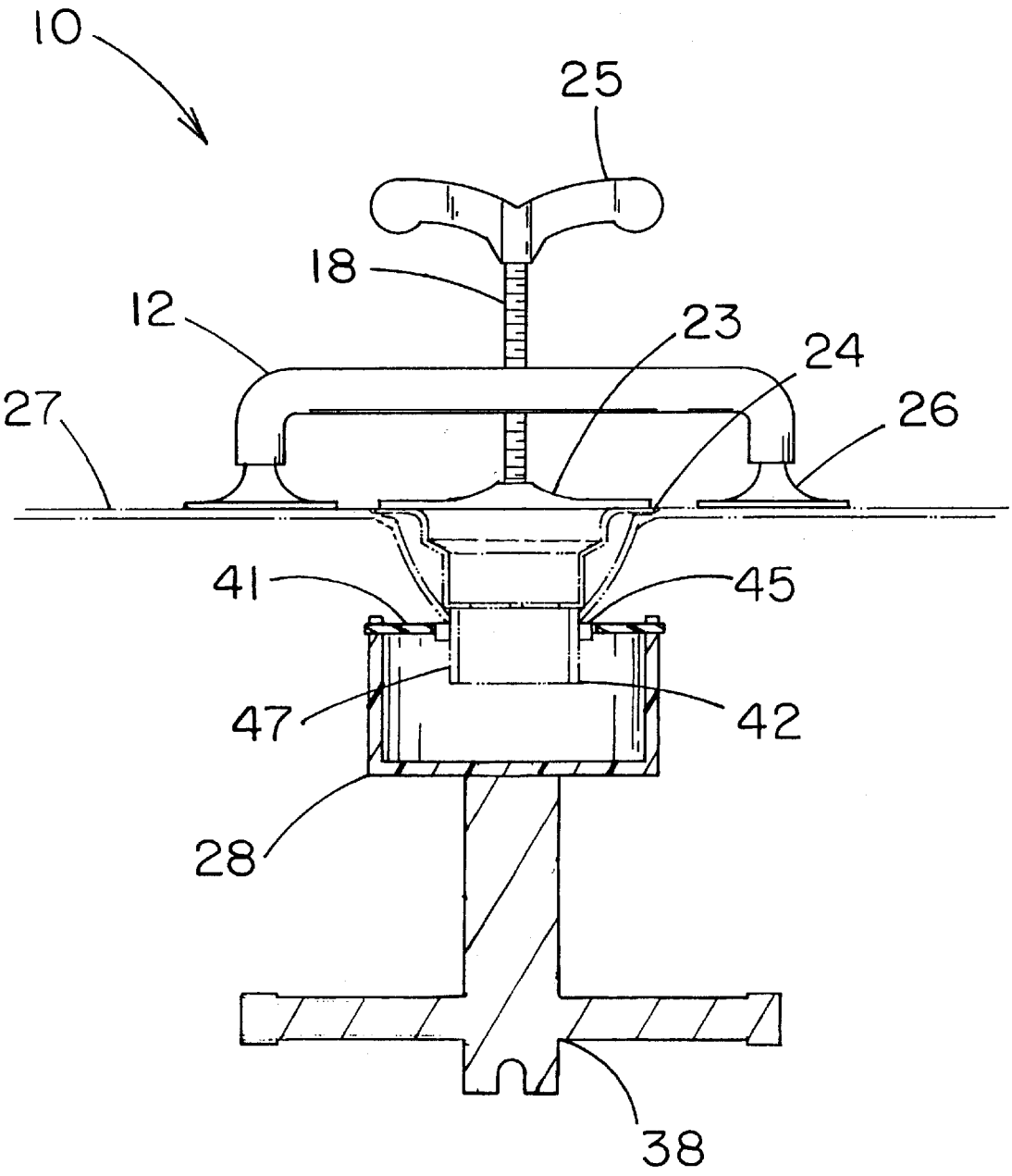
FIG. 5 is a schematic side view of the present invention utilizing the engaging member in conjunction with the cup member to secure the drain assembly utilizing the lower fastener.

With reference now to the drawings, and in particular to FIGS. 1 through 5 thereof, a new drain installation apparatus embodying the principles and concepts of the present invention and generally designated by the reference numeral 10 will be described.

As best illustrated in FIGS. 1 through 5, the drain installation apparatus 10 generally comprises a bridging member 12 for bridging over a drain hole 13 in a plumbing fixture 14. The bridging member 12 has a central portion 15 and a pair of end portions 16. A hole 17 is formed in the central portion 15 of the bridging member 12. The bridging member 12 has a substantially U-shaped configuration with the end portions 16 extending away from the central portion 15 in a substantially parallel orientation to each other.

A support member 18 extends toward the drain hole 13 when the bridging member 12 is positioned over the drain hole 13. The support member 18 is selectively advanceable toward the drain hole 13. The support member 18 is positioned in the hole 17 in the bridging member 12. An exterior 19 of the support member 18 and an interior 20 of the hole 17 in the bridging member 12 are threaded such that rotation of the support member 18 advances the support member 18 through the hole 17 in the bridging member 12. The support member 18 has a first end 21 and a second end 22.

A holding member 23 engages a top of a drain assembly 24. The holding member 23 is rotatably mounted on the first end 21 of the support member 18.

A handle member 25 is mounted on the support member 18 for being gripped by a hand of a user to rotate the support member 18. The handle member 25 is mounted on the second end 22 of the support member 18.

An attachment member 26 is mounted on the bridging member 12 for releasably mounting on an inner surface 27 of the plumbing fixture 14 adjacent to the drain hole 13. One attachment member 26 is mounted on each of the end portions 16 of the bridging member 12.

A cup member 28 engages an upper portion 29 of the drain assembly 24. The cup member 28 defines a cavity 30 for receiving the drain assembly 24. The cup member 28 has a central wall 31 and a peripheral wall 32 that extends from the central wall 31. The peripheral wall 32 has an edge 33 defining an opening 34 into the cavity 30.

A plurality of notches 35 is formed in the edge 33. The notches 35 are substantially uniformly separated along the edge 33 and a circumference of the opening 34 such that the notches 35 conform to an upper fastener 36. The cup member 28 is positionable around the upper portion 29 of the drain assembly 24 that protrudes through the drain hole 13 until the notches 35 fully receive the upper fastener 36 to facilitate securing the upper fastener 36 to a first threaded portion 37 of the drain assembly 24.

A lower handle member 38 is mounted on the cup member 28 for gripping by the hand of the user to facilitate rotation of the cup member 28. The lower handle includes a post member 39 extending from the cup member 28 and a cross member 40 mounted on the post member 39. The cross member 40 is mounted on the post member 39 in a manner such that the cross member 40 is oriented substantially perpendicular to the post member 39. The post member 39 is mounted on the central wall 31 of the cup member 28.

An engaging member 41 engages a lower portion 42 of the drain assembly 24. The engaging member 41 is removably mountable on the cup member 28. The engaging member 41 has an inner perimeter edge 43 defining an aperture 44. A shape of the aperture 44 is generally the same as a shape of a lower fastener 45. The engaging member 41 has an outer diameter generally equal to an inner diameter of the opening 34 in the cup portion such that the engaging member 41 is positionable in the cup member 28. A pair of tabs 46 extends radially outward from the engaging member 41 for engaging a number of the notches 35 in the cup member 28. The pair of tabs 46 extends from diametrically opposite locations on the engaging member 41. The engaging member 41 is positionable over the lower portion 42 of the drain assembly 24 until the aperture 44 fully receives the lower fastener 45 to facilitate securing the lower fastener 45 to a second threaded portion 47 of the drain assembly 24.

In use, the drain assembly is placed in the drain hole of the plumbing fixture. The user then affixes the bridging member to the top surface of the fixture with the end portions positioned on either side of the drain assembly. The support member is rotated until the holding member firmly holds it in place. The fixture is then turned over to reveal the underside with the drain assembly protruding outwardly.

Depending on the type of drain assembly and/or plumbing fixture, either the cup member and a collar fastener are used to secure the assembly to the fixture, or the engaging member used in conjunction with the cup member, and a hex-nut are used to secure the drain assembly to the fixture.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drain installation apparatus for installing a drain assembly in a drain hole of a plumbing fixture, said apparatus comprising:

an upper holding assembly for positioning above and bridging over the drain hole in the plumbing fixture, said upper holding assembly comprising:

a bridging member for bridging over the drain hole;

a support member for extending toward the drain hole when said bridging member is positioned over the drain hole;

a holding member for engaging a top of the drain assembly;

a handle member being mounted on said support member for being gripped by a hand of a user to rotate said support member; and an attachment member being mounted on said bridging member for releasably mounting on an inner surface of the plumbing fixture adjacent to the drain hole;

a lower holding assembly for positioning under the drain assembly below the drain hole in the plumbing fixture, said lower holding assembly comprising:

a cup member for engaging an upper portion of the drain assembly;

a lower handle member mounted on said cup member for gripping by the hand of the user to produce rotation of said cup member; and an engaging member for engaging a lower portion of the drain assembly.

2. The drain installation apparatus as set forth in claim 1, further comprising said bridging member having a central portion and a pair of end portions, a hole being formed in said central portion of said bridging member, a central axis of said hole being substantially parallel to each of said end portions.

3. The drain installation apparatus as set forth in claim 2, further comprising said bridging member having a substantially U-shaped configuration with said end portions extending away from said central portion in a substantially parallel orientation to each other.

4. The drain installation apparatus as set forth in claim 2, further comprising said support member being positioned in said hole in said bridging member, an exterior of a portion of said support member and an interior of said hole in said bridging member being threaded such that rotation of said support member advances said support member through said hole in said bridging member.

5. The drain installation apparatus as set forth in claim 1, further comprising said support member having a first end and a second end, said holding member being rotatably mounted on said first end of said support member, said handle member being mounted on said second end of said support member.

6. The drain installation apparatus as set forth in claim 2, further comprising one said attachment member being mounted on each of said end portions of said bridging member.

7. The drain installation apparatus as set forth in claim 1, further comprising said cup member defining a cavity for receiving the drain assembly, said cup member having a central wall and a peripheral wall extending from said central wall, said peripheral wall having an edge defining an opening into said cavity.

8. The drain installation apparatus as set forth in claim 7, further comprising a plurality of notches being formed in said edge, said notches being substantially uniformly separated along said edge and a circumference of said opening such that said notches conforming to an upper fastener.

9. The drain installation apparatus as set forth in claim 8, wherein said cup member is positionable over the upper portion of the drain assembly until said notches fully receive the upper fastener to facilitate securing the upper fastener to a first threaded portion of the drain assembly.

10. The drain installation apparatus as set forth in claim 7, further comprising said lower handle including a post member extending from said cup member and a cross member mounted on said post member, said post member being mounted on said central wall of said cup member.

11. The drain installation apparatus as set forth in claim 10, further comprising said cross member being mounted on said post member in a manner such that said cross member is oriented substantially perpendicular to said post member.

12. The drain installation apparatus as set forth in claim 1, further comprising said engaging member being removably mountable on said cup member.

13. The drain installation apparatus as set forth in claim 1, further comprising said engaging member having an inner perimeter edge defining an aperture, a shape of said aperture being generally the same as a shape of a lower fastener.

14. The drain installation apparatus as set forth in claim 7, further comprising said engaging member having an outer diameter generally equal to an inner diameter of said opening in said cup member such that said engaging member is positionable in said cup member.

15. The drain installation apparatus as set forth in claim 8, further comprising a pair of tabs extending radially outward from said engaging member for engaging a number of said notches in said cup member, said pair of tabs extending from diametrically opposite locations on said engaging member.

16. The drain installation apparatus as set forth in claim 13, wherein said engaging member is positionable over the lower portion of the drain assembly until said aperture fully receives the lower fastener to facilitate securing the lower fastener to a second threaded portion of the drain assembly.

17. A drain installation apparatus for installing a drain assembly in a drain hole of a plumbing fixture, said apparatus comprising:

an upper holding-assembly for positioning above and bridging over the drain hole in the plumbing fixture, said upper holding assembly comprising:

a bridging member for bridging over the drain hole, said bridging member having a central portion and a pair of end portions, a hole being formed in said central portion of said bridging member, said bridging member having a substantially U-shaped configuration with said end portions extending away from said central portion in a substantially parallel orientation to each other, a central axis of said hole being substantially parallel to each of said end portions;

a support member for extending toward the drain hole when said bridging member is positioned over the drain hole, said support member being selectively advanceable toward the drain hole, said support member being positioned in said hole in said bridging member, an exterior of a portion of said support member and an interior of said hole in said bridging member being threaded such that rotation of said support member advances said support member through said hole in said bridging member, said support member having a first end and a second end;

a holding member for engaging a top of the drain assembly, said holding member being rotatably mounted on said first end of said support member;

a handle member being mounted on said support member for being gripped by a hand of a user to rotate said support member, said handle member being mounted on said second end of said support member; and an attachment member being mounted on said bridging member for releasably mounting on an inner surface of the plumbing fixture adjacent to the drain hole, one said attachment member being mounted on each of said end portions of said bridging member;

a lower holding assembly for positioning under the drain assembly below the drain hole in the plumbing fixture, said lower holding assembly comprising:

a cup member for engaging an upper portion of the drain assembly, said cup member defining a cavity for receiving the drain assembly, said cup member having a central wall and a peripheral wall extending from said central wall, said peripheral wall having an edge defining an opening into said cavity, a plurality of notches being formed in said edge, said notches being substantially uniformly separated along said edge and a circumference of said opening such that said notches coincide with an upper fastener, wherein said cup member is positionable over the upper portion of the drain assembly until said notches fully receive the upper fastener to facilitate securing the upper fastener to a first threaded portion of the drain assembly.

a lower handle member mounted on said cup member for gripping by the hand of the user to produce rotation of said cup member, said lower handle including a post member extending from said cup member and a cross member mounted on said post member, said cross member being mounted on said post member in a manner such that said cross member is oriented substantially perpendicular to said post member, said post member being mounted on said central wall of said cup member;

an engaging member for engaging a lower portion of the drain assembly, said engaging member being removably mountable on said cup member, said engaging member having an inner perimeter edge defining an aperture, a shape of said aperture being generally the same as a shape of a lower fastener, said engaging member having an outer diameter generally equal to an inner diameter of said opening in said cup member such that said engaging member is positionable in said cup member, a pair of tabs extending radially outward from said engaging member for engaging a number of said notches in said cup member, said pair of tabs extending from diametrically opposite locations on said engaging member, wherein said engaging member is positionable over the lower portion of the drain assembly until said aperture fully receives the lower fastener to facilitate securing the lower fastener to a second threaded portion of the drain assembly.

* * * * *